United States Patent [19]

Berwald

[11] 3,963,144

[45] June 15, 1976

[54] TRANSPORT CONTAINER FOR DANGEROUS LIQUIDS

[75] Inventor: Ernst Berwald, Bergkamen-Heil, Germany

[73] Assignee: Schering Aktiengesellschat, Berlin and Bergkamen, Germany

[22] Filed: Dec. 12, 1974

[21] Appl. No.: 532,004

[30] Foreign Application Priority Data

Dec. 20, 1973 Germany ..... 2363471

[52] U.S. Cl. ..... 220/85 P; 137/382

[51] Int. Cl.[2] ..... B65D 25/00

[58] Field of Search ..... 220/85 P, 85 R, 334; 137/377, 382

[56] References Cited

UNITED STATES PATENTS

| | | | |
|---|---|---|---|
| 523,125 | 7/1894 | Lebach | 220/334 |
| 999,374 | 8/1911 | Kluge[illegible] | 220/334 |
| 2,609,964 | 9/1952 | Cadwell | 220/85 P |
| 2,711,610 | 6/1955 | Miller | 220/95 |
| 2,781,944 | 2/1957 | Clute | 220/85 P |
| 2,944,701 | 7/1960 | Hatanaka | 220/85 R |
| 3,185,336 | 5/1965 | Goss | 220/85 P |
| 3,643,690 | 2/1972 | Sarai | 220/86 R |
| 3,800,978 | 4/1974 | Sigwald | 220/85 R |

*Primary Examiner*—George E. Lowrance
*Assistant Examiner*—Allan N. Shoap
*Attorney, Agent, or Firm*—Curtis, Morris & Safford

[57] ABSTRACT

In a transport container for dangerous liquids, a protective shell is provided for the charging and emptying fittings mounted on the container. The shell consists of an upwardly opening shell structure mounted on the container and having a central portion which extends into the container, with a pair of exposed end portions that extend outwardly from the container; at least one of the exposed end portions is opened to allow drainage of fluid from the shell. The charging and emptying fittings, and other control devices, are positioned in the shell where they are protected against corrosion and breakage, and yet are readily accessible for operation.

4 Claims, 4 Drawing Figures

TRANSPORT CONTAINER FOR DANGEROUS LIQUIDS

The present invention relates to transport containers for dangerous liquid, and more particularly to a transport container structure providing a protective arrangement for the container fittings, valves and control devices.

In containers which are used to transport dangerous liquids, particularly for example organo-metallic compounds, metal halides, and the like which react vigorously either with oxygen or with water vapor in the air (so as to be essentially self-igniting if not properly controlled), the charging and emptying fittings or valves must be installed permanently in order to insure safe use of the container. The installation of these fittings and valves also must be substantially breakproof, and they must be protected against corrosion since, should the fittings or valves break or corrode, the dangerous liquid in the container could be released causing explosions, fires, or other undesirable reactions in the transport vessel, which typically is a ship or railroad car. On the other hand, the fittings and valves must be readily accessible in order to permit rapid operation during charging and filling of the container.

A number of previously proposed arrangements have been provided in containers for transporting dangerous liquids which are used to mount and protect the fittings and valves on the container. Such previously proposed arrangements however either substantially reduce the volume of the container available for holding liquid, or they increase the maximum external dimensions of the container, thereby increasing the amount of space occupied by the container in the transport vessel.

Accordingly, it is an object of the present invention to overcome the disadvantages of previously proposed container arrangements used to transport dangerous liquids.

Another object of the present invention is to provide a transport container arrangement with a shell or housing for the emptying and filling fittings or valves which requires the smallest possible amount of space either in the container or on the exterior thereof.

Yet another object of the present invention is to provide a transport container arrangement which provides ready access to and safe operation of the fittings and valves for emptying and filling the container.

A further object of the present invention is to provide a protective enclosure or shell for the emptying and filling fittings and valves of the transport container which allows free discharge of splash water from the shell, thereby to avoid problems of corrosion.

In accordance with an aspect of the present invention, the charging or filling and emptying fittings and valves for a generally cylindrical container are mounted in a protective shell which has a generally semi-cylindrical configuration. The shell is mounted on the container with a central portion thereof intersecting a portion of the periphery of the container so that the central portion of the shell is located within the container with the ends of the shell located exteriorly thereof. At least one end of the shell is open, so that splash water or other liquids which may enter the shell can be readily discharged therefrom. This is particularly important for example in maritime transportation systems wherein sea water splashing on the containers will be discharged from the shell enclosing the fittings.

The semi-cylindrical configuration reduces the height of the superstructure or enclosure in which the fittings are mounted, thereby reducing the overall size of the container and the amount of space or volume required in the transportation vessel for the container while at the same time a minimum of space within the container itself is required. As a result a maximum volume in the container is available for liquid.

The above, and other objects, features, and advantages of the invention, will be apparent in the following detailed description of an illustrative embodiment thereof which is to be read in connection with the accompanying drawings, wherein.

Figure 1:
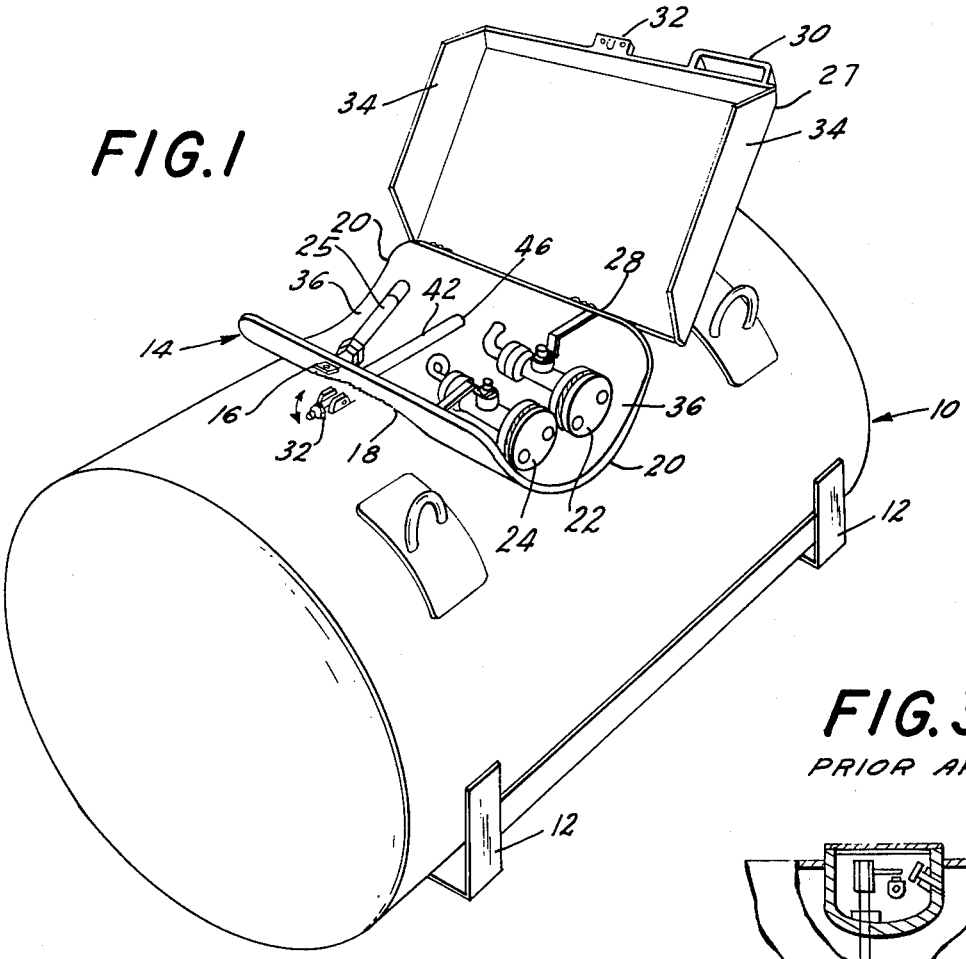
FIG. 1 is a perspective view of a transport container for dangerous liquids constructed in accordance with one embodiment of the present invention.

Referring now to the drawing in detail, and initially to FIG. 1 thereof, it will be seen that a container 10 for transporting dangerous liquids on a railroad car or on a ship has a generally cylindrical configuration and a plurality of rigid legs 12 secured thereto for supporting the container on the transport vehicle or vessel.

Figure 4:
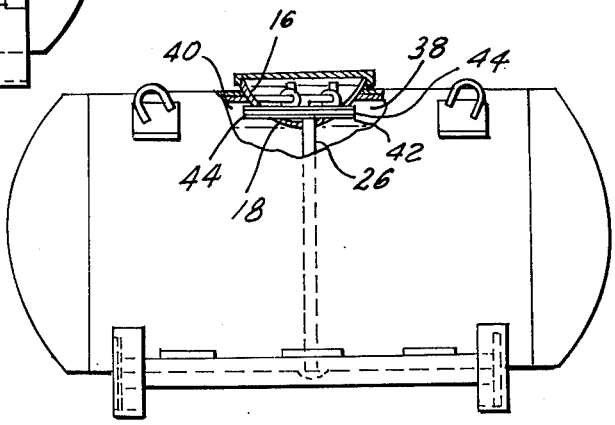
FIG. 4 is an elevational view, with parts broken away, of the transport container constructed in accordance with the present invention and taken along lines 4—4 of FIG. 1.

Container 10 is provided with a shell 14 in which the fittings or valves for use in emptying and filling the container are mounted. This shell has a generally semi-cylindrical configuration, and is rectangular in plan. The shell is welded or otherwise secured in watertight relation to an opening 16 in the container 10 and is positioned so that its major dimension extends transversely to the longitudinal central axis of the container. By this arrangement, as seen in FIG. 4, a central portion 18 of the shell is located within the periphery of the container 10 positioned chordally on said container with its longitudinal axis transverse to the longitudinal central axis of the container. On the other hand the ends 20 of the shell extend beyond the periphery of the container and are exposed on opposite sides of the longitudinal central axis of the container in spaced parallel relation to each other.

As mentioned, the shell 14 is adapted to contain and support the fittings and valves for the container. These fittings include a filling fitting or valve 22 and an emptying or discharge fitting 24. These fittings may for example be steel ball valves which can provide rapid connections to filling and emptying hoses or conduits. The valves are of conventional construction and need not be described here in detail. However they are securely mounted to the shell in a watertight relationship so as to avoid leakage of the dangerous liquids during the filling and emptying operation. The exact positions of the fitting valves within the confines of the shell may be varied as desired to meet any particular application.

The emptying valve 24 is preferably connected to a dip tube 26 in a conventional manner to insure complete emptying of the tank. As will be seen in FIG. 4 the dip tube extends to the base of the container so that the container can be completely emptied.

In addition, the shell 14 can contain various safety devices such as excess pressure safety valves, protective gas flushing connections, filling gauges, and heat sensing devices such as for example conventional meltable plug valves 25 and the like, all of which are conventionally used with containers for transporting dangerous liquids.

Preferably the container 10 is provided with a cover or lid 27 which is pivotally mounted in any convenient manner along one edge 28 to an edge of the shell 14. The lid may be provided with a handle 30 and a convenient locking arrangement 32 of conventional construction so that it can be securely held in position to cover the open upper portion of the shell. Preferably the cover includes side flanges 34 which partially cover the opened ends 36 of the shell.

As mentioned, the ends 36 of the shell are opened, and even with the flanges 34 covering these ends, access to the interior of the shell is permitted. By this arrangement, any liquid accumulating in the shell, such as for example splash water or rain water is drained from the shell and will not accumulate therein. This will avoid problems of corrosion of the metal fittings, valves and the like contained within the shell. Accordingly, the fittings and other devices in the shell will have a longer life and the danger of leakage of the dangerous liquid is reduced.

Figure 3:
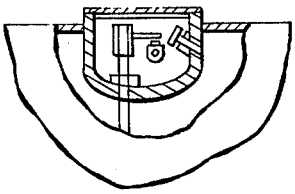
FIG. 3 PRIOR ART
FIG. 3 is a schematic partial elevational view, similar to FIG. 2, of another prior art embodiment.

Referring to FIG. 4, it will be appreciated that when the tank is substantially filled, the transversely extending shell will, in effect, separate the upper portion of the container into two sections 38, 40, so that two separate air spaces are defined in the container. In order to insure that these spaces have the same pressure in them, in order to allow maximum filling of the container, a pressure equalization tube 42 can be provided in the semi-cylindrical shell 14. This tube extends through and across the shell, as seen in FIG. 3, and has open ends 44 which provide communication between the two chamber sections 38, 40. The tube is preferably secured in the shell 14 by liquid tight seal, such as for example a weld 46 or the like, at the points where the tube crosses the shell casing.

By this arrangement of the present invention substantially all of the space within the container 10 remains available for filling with liquid, while at the same time only a minimum amount of space above (i.e. on the exterior of) the container is required. This is in contradistinction to previously proposed shell constructions for use with containers for transporting dangerous liquids, as shown for example in FIGS. 2 and 3. In the prior art device shown for example in FIG. 2, a dome shaped superstructure 50 is provided on the tank 10 which contains the various fittings, valves and safety devices used with the container. With this arrangement, the entire volume of the container is available for filling with liquid, but a substantial amount of space is required above the container in order to accommodate the fittings or valves 22, 24 and other safety devices. At the same time, the dome is provided with a plurality of openings 52 formed therein which allow discharge of rain water, or splash water from the sea, in order to avoid corrosion. However the provision of these apertures weakens the connection of the shell to the container. The substantial height added to the container 10 by the use of the shell 50 increases the amount of space or total volume required in the transport vessel in order to accommodate the container. As will be appreciated a substantial amount of this space is wasted, and thus increases unnecessarily the expense involved in transporting the container.

Figure 2:
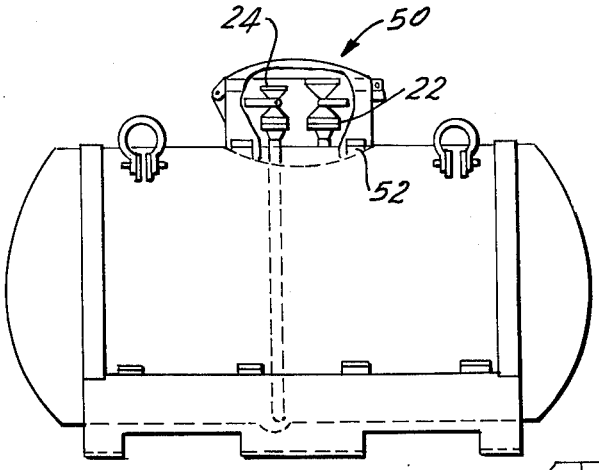
FIG. 2 PRIOR ART
FIG. 2 is a schematic side elevational view, with parts broken away, of a prior art container used in transporting dangerous liquids.

In order to reduce the amount of space required by the container, and to avoid the problems inherent in the device of FIG. 2, another previously proposed arrangement utilizes a shell construction which is of generally cylindrical configuration, as shown in FIG. 3. As seen therein this shell extends entirely into the container 10 and thereby considerably reduces the volume of the container available for storage of liquid. Moreover, this arrangement reduces the amount of space available for access to the various fittings contained within the shell and it is impossible to freely discharge splash or rain water which enters into the shell. Accordingly, the possibility of corrosion of the container, shell and fittings is substantially increased. This could create extremely dangerous conditions when dangerous substances are being transported.

The problem of both of the prior art arrangements are overcome according to the construction of the present invention wherein only a minimal amount of the volume of the container 10 itself is utilized by the shell 14 while on the other hand only a minimum additional height is added to the container. Thus the container can be substantially completely filled while only a minimum amount of space is occupied by the container and shell construction in the transport vessel. In addition, because of the configuration of the shell a substantially incresed amount of space is available for access to the fittings and safety devices contained within the shell, thereby facilitating the arrangement of the fittings in the shell in accordance with the needs of a particular construction.

As mentioned, containers of the type described in this application can be used to transport dangerous liquids which may be pure substances, solutions, suspensions, etc., which react vigorously with either oxygen or water vapor in the air. Such substances can for example consist of organometallic compounds, metal halides and the like. The arrangement of the present invention is not limited to a cylindrical configuration for a container but other configurations can also be used. Moreover, the shell construction can be used with containers of various sizes, and has been found completely satisfactory with containers having volumetric dimensions of 0.5 to 10 cubic meters.

Although an illustrative embodiment of the present invention has been described herein with reference to the accompanying drawing, it will be appreciated that various other changes and modifications can be effected therein by one skilled in the art without departing from the scope or spirit of this invention.

What is claimed is:

1. In a generally cylindrical transportation container for dangerous liquids having an upper portion and charging and emptying fittings on said upper portion, an elongated upwardly opening semi-cylindrical protective shell for the fittings positioned chordally on said container with its longitudinal axis transverse to the longitudinal central axis of said container; said shell being generally rectangular in plan and mounted on said upper end portion of said container with its central portion intercepting the periphery of the container and being located within the container; said shell having a pair of exposed end portions which extend outwardly of and beyond the periphery of said container, said end portions being located on opposite sides of said longitudinal central axis of said container in spaced parallel relation to each other and being opened to allow drainage of liquid from the shell; said fittings being positioned in said shell.

2. In a transportation container as defined in claim 1 wherein said shell is semi-cylindrical in cross-section along substantially its entire length.

3. In a transportation container as defined in claim 2 including a cover for selectively closing said shell.

4. In a transportation container as defined in claim 1 including a tube extending through said shell transversely of the major dimension thereof and having open ends respectively located within said container on opposite sides of said shell thereby to equalize pressure in said container on opposite sides of the shell when said container is substantially filled with liquid.

* * * * *